US005421109A

United States Patent [19]

Steele

[11] Patent Number: 5,421,109

[45] Date of Patent: Jun. 6, 1995

[54] UNDERWATER SITE CLEARANCE SWEEP APPARATUS AND METHOD

[75] Inventor: Kelly B. Steele, Harvey, La.

[73] Assignee: American Oilfield Divers, Inc., Lafayette, La.

[21] Appl. No.: 189,244

[22] Filed: Jan. 31, 1994

[51] Int. Cl.[6] ..... E02F 9/06

[52] U.S. Cl. ..... 37/345; 37/307; 37/394

[58] Field of Search ..... 37/345, 346, 307, 342, 37/313, 394, 395; 299/9, 8; 405/258

[56] References Cited

U.S. PATENT DOCUMENTS

| | | | |
|---|---|---|---|
| Re. 32,297 | 12/1986 | Oules | 37/345 X |
| 292,371 | 1/1884 | Du Bose Seabrook | 37/314 |
| 923,116 | 5/1909 | Crosby | 37/195 |
| 1,480,192 | 1/1924 | Worsfold | 37/307 |
| 1,959,793 | 5/1934 | Lafredo et al. | 37/314 X |
| 3,365,823 | 1/1968 | Vogt | 37/345 X |
| 3,367,048 | 2/1968 | Doughty | 37/195 |
| 4,010,560 | 3/1977 | Diggs | 37/314 X |
| 4,052,800 | 10/1977 | Fuhrboter et al. | 37/195 X |
| 4,073,078 | 2/1978 | Leitz | 37/342 |
| 4,076,313 | 2/1978 | Sperandeo, III | 299/8 |

*Primary Examiner*—David H. Corbin
*Assistant Examiner*—Victor Batson
*Attorney, Agent, or Firm*—Popham, Haik, Schnobrich & Kaufman, Ltd.

[57] ABSTRACT

A method of removing objects from the bottom of a body of water around a well head includes a vessel spooling out a link-chain or a cable-net from a winch located on the vessel, with the opposite end of the link-chain or cable-net attached to a swivel assembly placed over a vertical pile that marks the well head site. The link-chain or cable-net is laid along a path defined by a radius and a portion of the circumference extending from that radius of a circle of predetermined diameter. The vessel then lowers spuds to establish a rigid position and the link-chain or cable-net is winched in. Objects on the bottom of the body of water are either picked up by the net, or obstruct the link-chain or cable-net and can be marked for retrieval.

12 Claims, 3 Drawing Sheets

UNDERWATER SITE CLEARANCE SWEEP APPARATUS AND METHOD

BACKGROUND OF THE INVENTION

1. Field of the Invention

The present invention relates to a method and apparatus for sweeping the bottom of a body of water around a central point such as, for example, a well head. More specifically, the invention relates to a method of locating and removing objects from the bottom of a body of water around a central point using a vessel and a cable or chain, with or without a net attached thereto, one end of the cable or chain being attached to a winch on the vessel, and the other end of the cable or chain being attached to a swivel assembly placed over a vertical pile located at the central point.

2. Related Art

U.S. Pat. No. 4,802,292 shows an apparatus for mining materials from the bottom of a body of water. The apparatus includes an endless rope, a driving mechanism and a large number of buckets, all attached to a vessel. The vessel is steered ahead as the driving mechanism continuously feeds out the endless rope with attached buckets. This apparatus does not provide a means for removing all objects on the bottom of a body of water within an area circumscribed by a circle of predetermined diameter.

U.S. Pat. No. 4,055,006 shows an apparatus for hoisting ores from the bottom of a body of water. A number of nets are provided on a flexible, endless member hanging from an ore-collecting vessel, and a separate ore collecting and filling mechanism is towed by a winch connected to a power and towing vessel floating ahead of the ore-collecting vessel. This apparatus requires the use of two vessels, and does not provide a means for removing all objects on the bottom of a body of water within an area circumscribed by a circle of predetermined diameter.

SUMMARY OF THE INVENTION

In view of the foregoing, it is a primary object of the present invention to disclose and provide a method for sweeping the bottom of a body of water around a central point and locating and removing all objects from the bottom of the body of water within an area circumscribed by a circle of predetermined diameter.

According to a preferred embodiment of the present invention, a vessel spools out a link-chain, wherein one end of the link-chain is attached to a mechanical winch on the vessel, and the opposite end of the link-chain is connected to a swivel assembly that is dropped over a pile marking a central point such as a well head. The link-chain is laid along a path defined by a radius and a segment of the circumference extending from that radius of a circle of predetermined diameter having its center at the central point. The vessel then lowers spuds to establish a rigid position and the link-chain is winched in. The link-chain is then swept across the bottom of the body of water, and will hang up on any object, which will subsequently be marked by a diver for retrieval. Buoys attached to the link-chain by lines at spaced intervals, quickly facilitate the identification of the location of such objects which obstruct the sweep of the link-chain. The sweep is conducted for one complete revolution of the circle in a clockwise direction, and then the process is repeated in a counterclockwise direction. This procedure is necessary in order to locate objects that the link-chain would slide over in one direction.

After the entire area circumscribed by the circle of predetermined diameter has been swept by the link-chain, the entire process is repeated after replacing the link-chain with a cable-net. The cable-net will remove most of the remaining objects on the bottom of the body of water surrounding the well head. When the cable-net becomes obstructed by any object too large to be gathered up by the net, the winch will be stopped and a diver will follow the net to the object, trip the net over the object, and if the object cannot be reached by a crane on the vessel, will mark the object with a temporary buoy for later retrieval.

This method of sweeping the bottom of the body of water around a well head using a cable-net attached between a winch on a vessel and a pile marking the location of the well head, allows for substantial cost savings over prior art devices and methods. Because the operation is performed from one vessel, eliminating the need for a second vessel, substantial savings are realized. In addition, because the cable-net is retrieved by a winch mounted on the vessel, and not by movement of the vessel itself, damage to the cable-net is largely eliminated. When the net becomes fouled on a large object, the winch is immediately stopped, and large stresses on the net assembly are eliminated.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
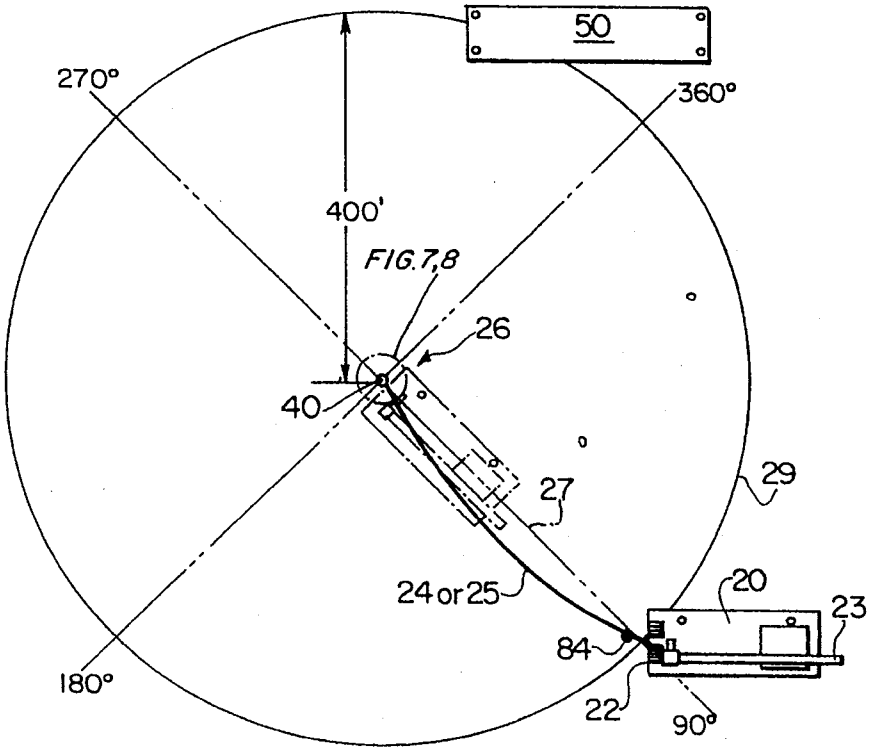
FIG. 1 is a plan view which illustrates the method by which the vessel is moved away from the pile after dropping the swivel assembly over the pile, and cable is continuously spooled out from the vessel.
Figure 8:
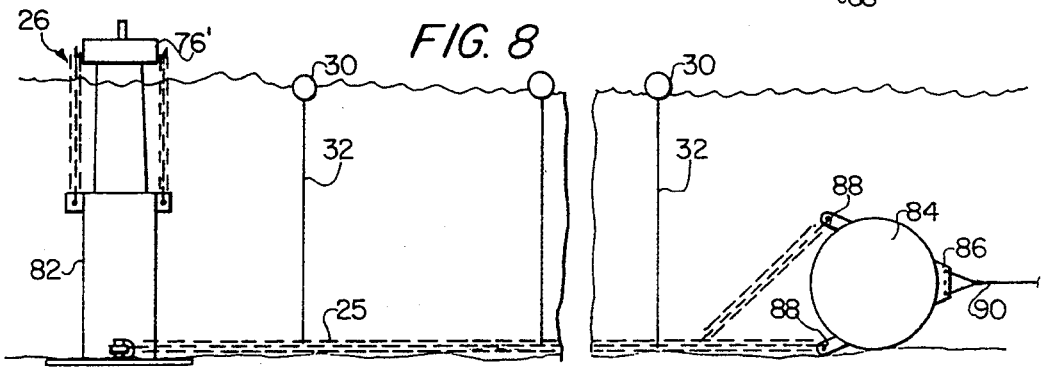
FIG. 8 illustrates a link-chain attached between the swivel assembly, which is placed over the pile, and the pulling sphere, which is connected to the vessel by a pull chain; and having spaced lines and marker buoys.

Referring initially to FIG. 1, a vessel 20 is shown in phantom at an initial position above a well head marked by a vertical pile 40. When in this position, a swivel assembly 26 attached to a distal end of a link-chain 25 as shown in FIG. 8 is dropped over the vertical pile 40 that marks a well head location. The proximal end of link-chain 25 is attached to a pulling sphere 84, and pulling sphere 84 is connected by a pull cable 90 to winch 22 mounted on the vessel 20.

Figure 5:
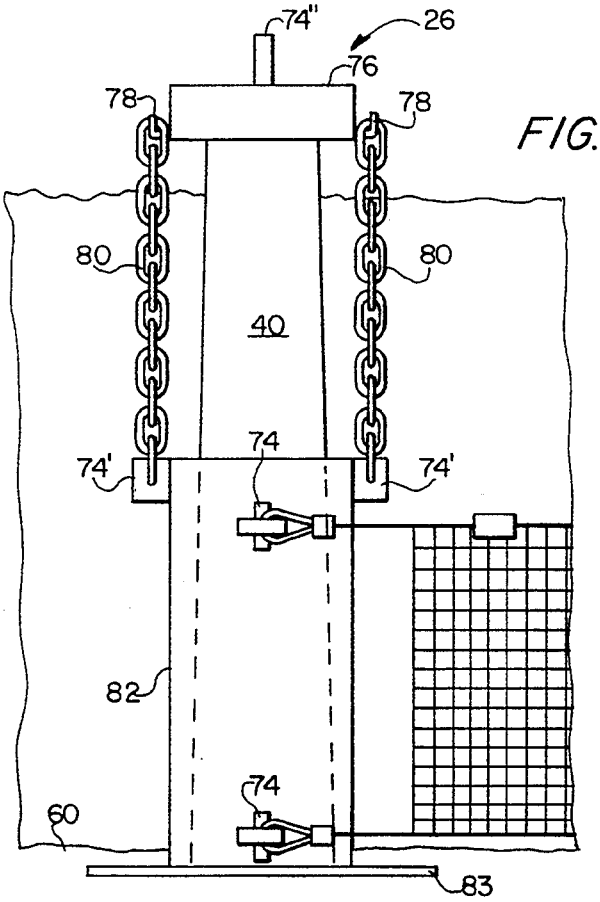
FIG. 5 illustrates the swivel assembly for attachment of the link-chain or cable-net to the pile.

Referring to FIG. 5, swivel assembly 26 comprises a segment of pipe 82 that fits loosely over pile 40 and rests on a compression mat 83 that is placed around pile 40 at the bottom 60 of the body of water surrounding pile 40. Pipe segment 82 has a plurality of pad eyes 74 welded to its outer periphery in a vertical line parallel to its central axis. The lowermost one of these pad eyes provides means for attaching the distal end of link-chain 25 to swivel assembly 26. Additional pad eyes 74' are welded at spaced intervals around the uppermost edge of pipe segment 82 and provide means for connecting adjustable lengths of chain 80 between pipe segment 82 and a pile cap 76. Pile cap 76 rests on the upper end of pile 40 and has a main pad eye 74" welded to its top surface to provide a means for raising and lowering the entire swivel assembly 26 over pile 40. Circumferentially spaced chain hooks 78 protrude radially outwardly from pile cap 76 and provide means for suspending adjustable chains 80 and pipe segment 82 from pile cap 76. The length of chains 80 is selected, depending on the height of pile 40, so that pipe segment 82 will rest on compression pad 83 at the bottom 60 of the body of water surrounding pile 40.

Figure 6:
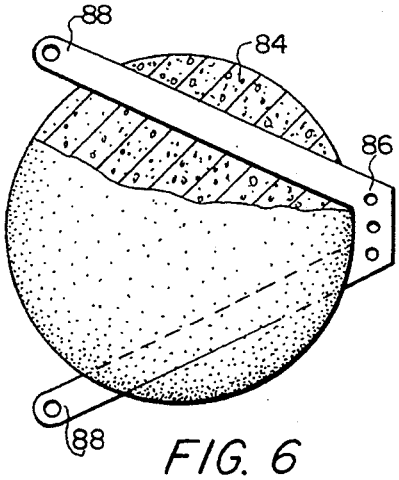
FIG. 6 illustrates the pulling sphere used for pulling the cable-net and the chain.
Figure 7:
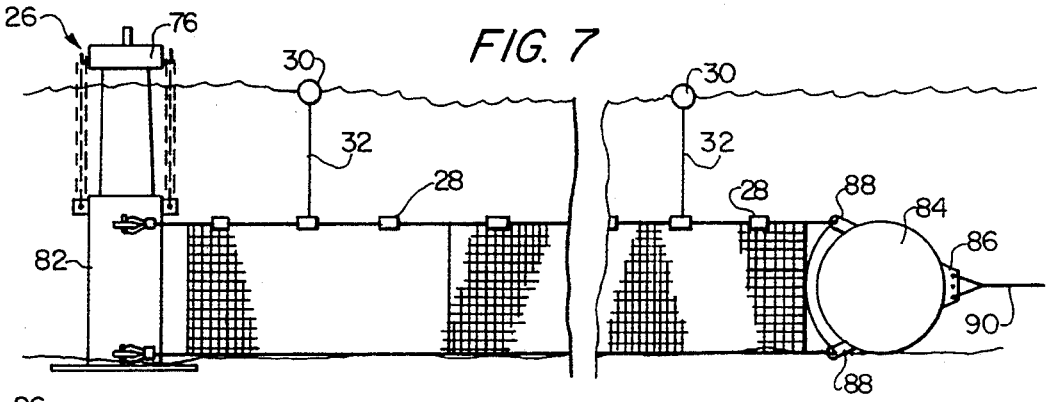
FIG. 7 illustrates the cable-net attached between the swivel assembly, which is placed over the pile, and the pulling sphere, which is connected to the vessel by a pull chain; and having spaced floats for maintaining the net in a vertical orientation.

Referring to FIG. 6, pulling sphere 84 is formed by casting a cement sphere around a gusset lying on a plane through the center of the sphere with corners of the gusset protruding from the cement sphere and forming a leading edge bracket 86 and two trailing edge brackets 88. As shown in FIGS. 7 and 8, pulling sphere 84 is connected to a pull chain 90 at the leading edge bracket 86 and is connected to either link-chain 25 (FIG. 8) or cable-net 24 (FIG. 7) at the trailing edge brackets 88. Pulling sphere 84 slides along bottom 60 as pull chain 90 is retracted onto winch 22 and serves to keep the proximal end of either link-chain 25 or cable-net 24 from being buried into mud on bottom 60 as the sweep is performed. Pulling sphere 84 also serves to keep cable-net 24 spread open during the sweep of bottom 60.

After dropping swivel assembly 26 over pile 40, vessel 20 then moves away from pile 40 in a straight line 27 which defines the radius of a circle 29 as shown in FIG. 1. While vessel 20 moves away from pile 40, cable 90 is spooled out from winch 22 continuously to deploy link-chain 25 and pulling sphere 84. Once vessel 20 has reached the desired distance from pile 40, which distance would be approximately 400 feet in the example of FIGS. 1 and 2, vessel 20 will maneuver to either starboard or port and move along a segment of the circumference of circle 29 to a desired position, such as the 360 degree radius of circle 29 as shown in FIG. 2.

Figure 2:
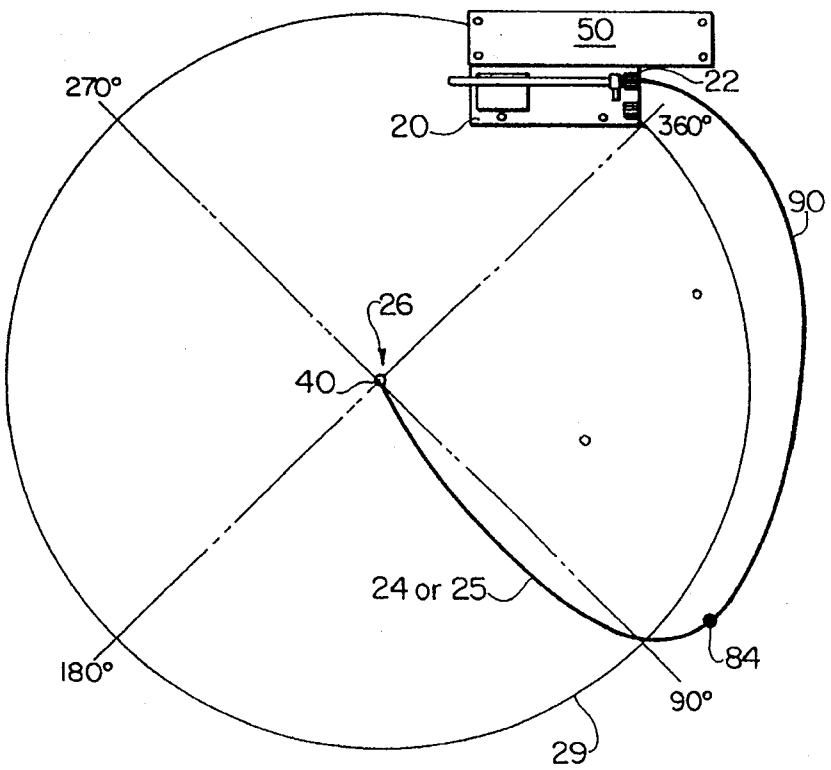
FIG. 2 is a plan view which illustrates the method by which the vessel is moved from the FIG. 1 position along a segment of the circumference of a circle having a desired radius, while continuously spooling out cable.

As illustrated in FIG. 2, cable 90 is spooled out continuously from winch 22 on vessel 20 to deploy link-chain 25 as vessel 20 moves along the perimeter of the circle to its first destination as shown in FIG. 2. A material barge 50 is positioned adjacent this first destination and serves as a receptacle for any objects to be removed from the bottom 60 of the body of water above the well head. Typically, a roller fairlead is provided on the headlog of the vessel to allow the retrieval of link-chain 25 or cable net 24 onto winch 22 regardless of the orientation of vessel 20.

Link-chain 25 is normally deployed first from winch 22 during the procedure in the manner shown in FIG. 8, in order to allow for location and removal of objects 62. After the entire area circumscribed by the circle traversed by vessel 20 has been swept by link-chain 25 in one direction, the sweep with link-chain 25 is repeated in reverse manner in the opposite direction. This procedure insures that objects oriented so that link-chain 25 simply slides over them when dragged in one direction will be detected by link-chain 25 when the sweep is conducted in the opposite direction.

After completing the two sweeps in opposite directions of the area around the well head with link-chain 25, link-chain 25 is replaced with cable-net 24 and cable-net 24 is deployed for a final sweep of the area around the well head in the same manner as the first two sweeps using link-chain 25.

Regardless of whether link-chain 25 or cable-net 24 is deployed from winch 22, the entire area circumscribed by the circle shown in FIGS. 1–4 and traversed by vessel 20 is swept in a plurality of sectors.

After vessel 20 reaches the destination shown in FIG. 2, spuds 21 are lowered from vessel 20 to the bottom 60 of the body of water surrounding the well head. Vessel 20 is then jacked up on spuds 21, thereby achieving a stationary position relative to pile 40 and the well head. After reaching this destination, the first of a plurality of sectors is swept by gradually winching in pull chain 90. As winch 22 is operated to retrieve link-chain 25, link-chain 25 drags along bottom 60 of the body of water surrounding pile 40, pulled by pull chain 90 and pulling sphere 84, while swivel assembly 26 attached to the distal end of link-chain 25 rotates freely about pile 40.

Figure 3:
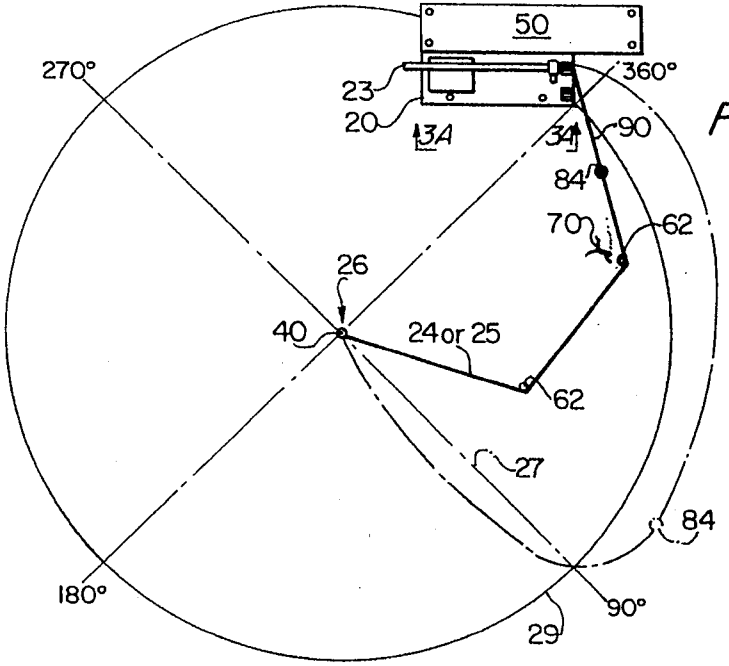
FIG. 3 is a plan view which illustrates the cable-net snagged on two objects with a diver preparing to trip the cable-net over one of the objects and mark it with a buoy.
Figure 3A:
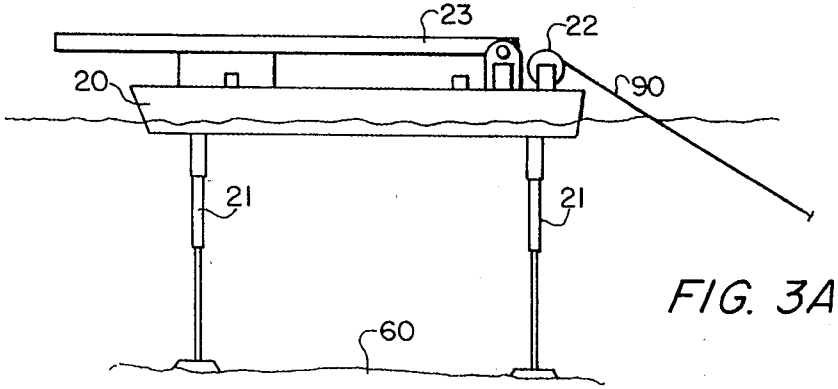
FIG. 3*a* is an elevation view which illustrates the vessel with spuds down and holding the vessel stationary prior to retrieving the cable onto the winch.

As illustrated in FIG. 3, when link-chain 25 is initially retrieved by winch 22 in order to sweep the first sector, link-chain 25 may become obstructed by objects 62. An operator of winch 22 will know immediately when link-chain 25 has been obstructed by an object 62 since link-chain 25 will increase tension and begin to rise out of the water at an accelerated rate. Obstruction of link-chain 25 can also be detected by a sudden change in the alignment of buoys 30 that are attached to link-chain 25 by lines 32 at spaced intervals. At this time the operator will immediately stop winch 22 and a diver 70 will enter the water to mark the object 62 creating an obstruction to link-chain 25. The location of object 62 is easily determined by following the plurality of buoys 30 that are attached to link-chain 25 by lines 32 at spaced intervals. Typically buoys are spaced every 30 feet with every fifth buoy colored red and the other buoys colored orange.

Figure 4:
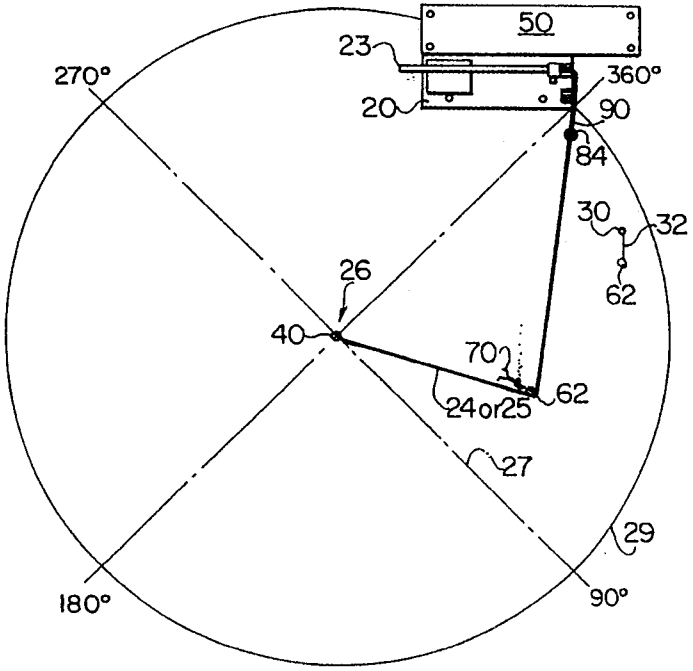
FIG. 4 is a plan view which illustrates the cable-net still snagged on a second object after the diver has tripped the cable-net over a first object shown in FIG. 3 and a diver marking the second object with a buoy for later retrieval.

As illustrated in FIG. 4, upon reaching the first of objects 62 obstructing link-chain 25, the diver 70 will trip link-chain 25 over object 62 and mark object 62 by attaching a line 32 and buoy 30 to object 62.

A crane 23 mounted on vessel 20 will subsequently be used to remove objects 62 from the water surrounding the well head, and place objects 62 onto material barge 50.

If object 62 can be reached by crane 23 with vessel 20 located at its first destination, as shown in FIG. 2, it will be removed immediately. If diver 70 is forced to mark objects 62 with a line 32 and buoy 30, as shown in FIG.

4, the sweep of the first sector will continue as shown in FIG. 4. The operation will be continued until the entire first sector has been swept and all objects 62 have been marked or retrieved.

After a sweep of the first sector has been completed, spuds 21 will be raised and vessel 20 will be moved along the perimeter of circle 29 from the 360° position to the next radius 270° position while continuously spooling out link-chain 25. The entire process of winching in link-chain 25 and marking or retrieving objects 62 will be repeated while vessel 20 is at the successive 180° and 90° positions around the circumference of circle 29 until the total area circumscribed by circle 29 is swept and debris removed therefrom.

After completion of the sweep in a first (counter-clockwise) direction by link-chain 25 of the entire area circumscribed by circle 29, the entire process is repeated by sweeping with link-chain 25 in the opposite (clockwise) direction. After completing the two sweeps in opposite directions with link-chain 25, link-chain 25 is replaced with cable-net 24. As shown in FIG. 7, cable-net 24 is maintained in vertical orientation by floats 28. Cables defining the top and bottom boundaries of cable-net 24 are connected to the vertically aligned pad eyes 74 welded to the outer periphery of pipe segment 82. These pad eyes 74 are positioned along a vertical line parallel to the central axis of pipe segment 82 and swivel assembly 26. Swivel assembly 26 is fitted over pile 40 as shown in FIGS. 5 and 7. Cable-net 24 will detect and permit removal of smaller objects which would not be detected by link-chain 25. Baffles can be placed at spaced intervals along cable-net 24 to facilitate collection of these smaller objects. Buoys 30 and lines 32 can optionally be associated with cable-net 24 if desired. Any objects 62 too large for retrieval by cable-net 24 can be marked by a diver for later retrieval or retrieved immediately by crane 23 as with the initial sweep by link-chain 25.

All objects 62 removed from the site will be identified and recorded on a perimeter graph with exact location indicated by distance and orientation from pile 40. To facilitate in the marking of the exact location of objects 62 on the perimeter graph, an array of markers can be placed around pile 40 on a circle having a radius of approximately 425 feet, with the markers spaced around the circumference of the circle at 45 degree intervals and one of the markers located at the northernmost position on the circle. A small vessel having an electronic guidance system can be used for this purpose.

It should be understood that while a preferred embodiment is disclosed, the invention is not limited thereto and is defined solely by the claims. For example, the arcuate sectors are not limited to 90° sectors and 45° or other size sectors could be employed.

Designators

20—clean sweep vessel
21—spuds
22—winch
23—crane
24—cable-net
25—link-chain
26—swivel assembly
27—radius
28—float
29—circle
30—buoy
32—buoy line
40—pile
50—material barge
60—bottom
62—object
70—diver
74—pad eye for attachment of link-chain or cable-net
74'—pad eye for attachment of adjustable chain
74''—pad eye for raising and lowering swivel assembly
76—pile cap
78—chain hook
80—adjustable chain
82—pipe segment
84—pulling sphere
86—leading edge bracket
88—trailing edge bracket
90—pull cable

What is claimed is:

1. A method for sweeping the bottom of a body of water around a central point comprising the steps of:

a) placing a swivel assembly attached to one end of a link-chain over a pile marking the central point location;

b) spooling out said link-chain from a winch operatively connected to the other end of said link-chain, wherein said winch is located on a vessel;

c) moving said vessel away from said pile along a path defined by a radius of a circle having a predetermined diameter and a first portion of the circumference of said circle extending from said radius;

d) lowering spuds from said vessel to the bottom of the body of water around the central point location;

e) jacking up said vessel on said spuds to secure said vessel in a stationary position relative to the central point location;

f) operating said winch to retrieve said link-chain onto said winch;

g) stopping said winch in response to detection of engagement of the link-chain with an object indicating obstruction of the link-chain by such object;

h) establishing the position of the object; and i) removing the object from the water.

2. The method of claim 1 wherein establishing the position of the object is effected by a diver locating the object by following buoys that are connected to said link-chain by buoy lines at spaced intervals.

3. The method of claim 1 wherein the object is removed from the water by a crane mounted on said vessel.

4. The method of claim 1 further including the steps of:

j) raising said spuds;

k) spooling out said link-chain from said winch;

l) moving said vessel along a second portion of the circumference of said circle; and m) repeating steps (d)–(i) of claim 1.

5. The method of claim 4 wherein the steps (b)–(m) are repeated until the area circumscribed by said circle has been completely swept by said link-chain for objects on the bottom of the body of water.

6. The method of claim 1 including the further steps of:

j) removing said link-chain from said pile and said winch;

k) replacing said link-chain with a cable-net having at least one ring attached to one end of said cable-net;

l) placing said ring over said pile marking the central point location;

m) spooling out said cable-net from said winch attached to the other end of said cable-net, wherein said winch is located on said vessel;

n) moving said vessel away from said pile along a path defined by a radius of a circle having a predetermined diameter and a first portion of the circumference of said circle extending from said radius;

o) lowering spuds from said vessel to the bottom of the body of water around the central point location;

p) jacking up said vessel on said spuds to secure said vessel in a stationary position relative to the central point location;

q) operating said winch to retrieve said cable-net onto said winch;

r) stopping said winch in response to detection of engagement of said cable-net with an object indicating obstruction of said cable-net by such object;

s) establishing the position of the object; and t) removing the object from the water.

7. The method of claim 6 wherein establishing the position of the object detected by said cable-net is effected by a diver following said cable-net to the object, lifting said cable-net over the object, and marking the object by attaching a line and buoy to the object.

8. The method of claim 6 wherein the object is removed from the water by a crane mounted on said vessel.

9. The method of claim 6 further including the steps of:

u) raising said spuds;

v) spooling out said cable-net from said winch;

w) moving said vessel along a second portion of the circumference of said circle; and x) repeating steps (o)–(t) of claim 6.

10. The method of claim 9 wherein the steps (m)–(x) are repeated until the area circumscribed by said circle has been completely swept by said cable-net for objects on the bottom.

11. An apparatus for sweeping the bottom of a body of water around a well head, said apparatus comprising:

a vessel;

a crane and a winch mounted on said vessel;

a cable-net having a proximal and a distal end;

the proximal end of said cable-net operatively connected to said winch;

a swivel assembly attached to the distal end of said cable-net;

a vertical pile for marking the location of the well head; and said swivel assembly placed over said pile with sufficient clearance between said swivel assembly and said pile to allow free movement of said swivel assembly.

12. An apparatus for sweeping the bottom of a body of water around a well head, said apparatus comprising:

a vessel;

a crane and a winch mounted on said vessel;

a link-chain having a proximal and a distal end;

the proximal end of said link-chain operatively connected to said winch;

a swivel assembly attached to the distal end of said link-chain;

a vertical pile for marking the location of the well head;

said swivel assembly placed over said pile with sufficient clearance between said swivel assembly and said pile to allow free movement of said swivel assembly; and a plurality of lines with buoys attached at spaced intervals along said link-chain.

* * * * *